US008991405B2

(12) United States Patent
Rose

(10) Patent No.: US 8,991,405 B2
(45) Date of Patent: Mar. 31, 2015

(54) SUBSTANCE APPLICATOR

(76) Inventor: Kathryn Hope Rose, Venice, CA (US)

( * ) Notice: Subject to any disclaimer, the term of this patent is extended or adjusted under 35 U.S.C. 154(b) by 0 days.

(21) Appl. No.: 13/195,463

(22) Filed: Aug. 1, 2011

(65) Prior Publication Data

US 2012/0042891 A1 Feb. 23, 2012

Related U.S. Application Data

(60) Provisional application No. 61/369,383, filed on Jul. 30, 2010.

(51) Int. Cl.

| | |
|---|---|
| ***A45D 29/18*** | (2006.01) |
| ***A45D 34/04*** | (2006.01) |
| ***A45D 29/20*** | (2006.01) |
| ***A45D 29/04*** | (2006.01) |

(52) U.S. Cl.

CPC ..... *A45D 29/20* (2013.01); *A45D 29/04* (2013.01); *A45D 34/045* (2013.01); *A45D 2200/053* (2013.01)

USPC ..... 132/73.5; 132/75

(58) Field of Classification Search

CPC ... A45D 34/045; A45D 29/20; A45D 29/007; A45D 34/00

USPC ..... 132/73.5, 317, 320, 218, 76.5, 74.5, 75; 401/121, 126–130; 206/361

See application file for complete search history.

(56) References Cited

U.S. PATENT DOCUMENTS

| | | | | |
|---|---|---|---|---|
| 2,516,423 | A * | 7/1950 | Roe | 132/75.6 |
| 2,623,229 | A * | 12/1952 | Brinton | 401/128 |
| 3,384,547 | A * | 5/1968 | Palmerio et al. | 401/9 |
| 3,397,707 | A * | 8/1968 | Aversa | 132/317 |
| 4,370,989 | A * | 2/1983 | Taylor | 132/317 |
| 4,579,134 | A * | 4/1986 | Moore | 132/320 |
| 4,602,651 | A * | 7/1986 | Roppatte, Jr. | 132/320 |
| 6,516,947 | B1 * | 2/2003 | Van Dyke et al. | 206/361 |
| 7,303,347 | B1 * | 12/2007 | Duncan | 401/123 |

* cited by examiner

*Primary Examiner* — Robyn Doan

(74) *Attorney, Agent, or Firm* — Volpe and Koenig, P.C.

(57) ABSTRACT

An applicator assembly is provided, the applicator assembly includes a base member, a cap member removably associated with the base member, a container for a substance to be applied; and an applicator member removably associated with the container. The container and applicator member are configured to be received within an interior space defined between the base member and cap member.

20 Claims, 3 Drawing Sheets

SUBSTANCE APPLICATOR

CROSS REFERENCE TO RELATED APPLICATION

This application claims the benefit of U.S. Provisional Application No. 61/369,383, filed on Jul. 30, 2010, which is incorporated by reference as if fully set forth.

FIELD OF INVENTION

This application is generally related to a substance applicator such as nail polish applicators.

BACKGROUND

Substance applicators are generally well known to be used for nail polish. Non-disposable nail polish containers have been well known in the art. Nail polish containers generally consist of a bottle and an applicator attached to a screw-top cap. Due to misplaced caps for these containers, nail polish can evaporate when exposed to air or be susceptible to spillage. Additionally, the applicator elements are known to become worn out and ineffective after repeated usage. These common problems have led to inventions disclosing applicators which are single-use, thus partially overcoming some problems associated with non-disposable nail polish containers.

One such type of a disposable nail polish applicator uses a frangible ampul and a brush attached to the bottom of a housing. Once grasped, the housing breaks the ampul and releases nail polish into a chamber and to the brush. Such a device presents obvious disadvantages, as there is no sturdy base in which the brush can rest during application of the nail polish.

A need exists for a disposable substance applicator assembly that is free-standing, wherein the applicator container is removable from the base and a nail filing element is incorporated in the applicator assembly.

Therefore, a need exists for a substance applicator assembly, which contains a substance in a sealed container and is disposable after one use. Further, a need exists for a sealed container for the substance that can be manually opened, allowing for a user to remove the applicator with a desired amount of substance and to provide for a free-standing substance applicator with a nail filing element.

SUMMARY

The applicator assembly comprises a base member, a cap member removably associated with the base member, a container for a substance to be applied; and an applicator member removably associated with the container. The container and applicator member are configured to be received within an interior space defined between the base member and cap member.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangement shown.

DETAILED DESCRIPTION OF THE PREFERRED EMBODIMENTS

Figure 1:
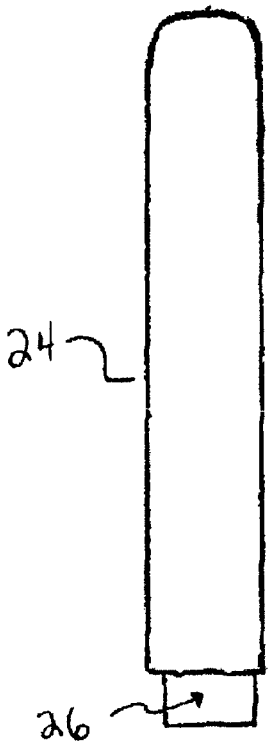
FIG. 1 is a front elevation view of the cap member.

Certain terminology is used in the following description for convenience only and is not limiting. The words "top," "bottom," "inner," and "outer" designate directions in the drawings to which reference is made. The terminology includes the words specifically noted above, derivatives thereof, and words of similar import.

FIG. 1 shows the cap member 24. In one embodiment, the cap member 24 is hollow and has one end with a threaded portion 26. The mating end 26 of the cap member 24 engages the mating portion 32 of the base member 28.

Figure 2:
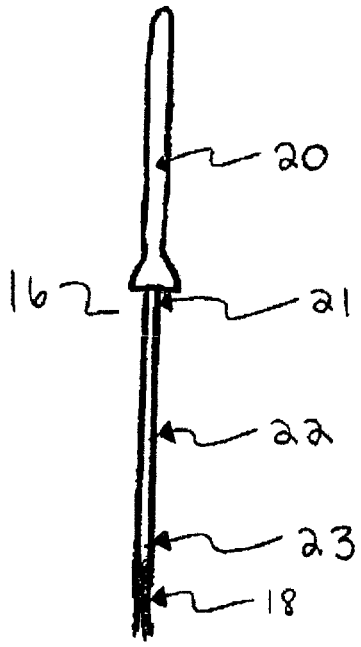
FIG. 2 is a front elevation view of the applicator.

FIG. 2 shows the applicator member 16. The applicator member 16 includes an applicator element 18. The applicator element 18 is used for applying a substance to a desired surface, such as nails. The applicator element 18 is connected to the applicator handle 20 via an elongated portion 22. The elongated portion 22 has a first end 21 and a second end 23.

Figure 3:
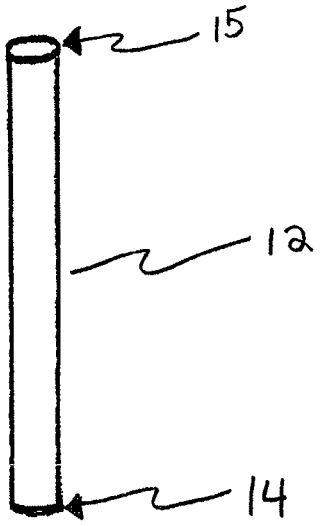
FIG. 3 is a perspective view of the applicator container.

FIG. 3 shows the applicator container 12. The applicator container 12 is hollow and open at a first end 14. The second end 15 is closed. The applicator container 12 holds substances in the upright position while resting its second end 14 in the recessed portion 30 of the base member 28.

Figure 4:
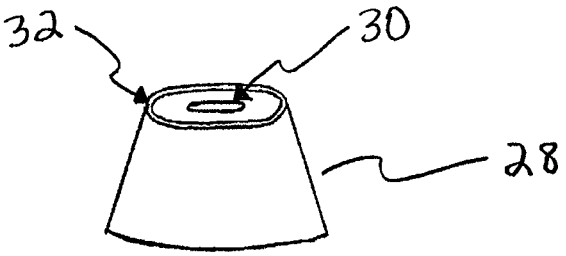
FIG. 4 is a perspective view of the base member.

FIG. 4 shows the base member 28. The base member 28 has a recessed portion 30, which is used for supporting the first end 14 of the applicator container 12. The base member 28 has a mating portion 32 that is used for receiving the mating end 26 of the cap member 24.

Figure 5:
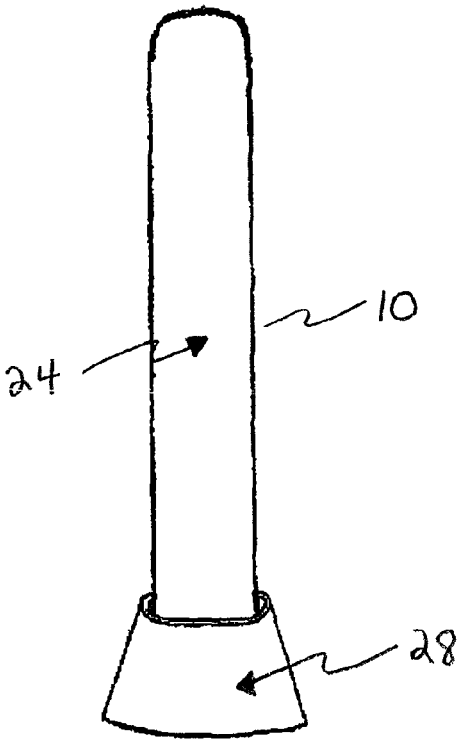
FIG. 5 is a perspective view of the applicator assembly.

FIG. 5 shows the applicator assembly 10. Here, the applicator assembly 10 is shown fully assembled, with the cap member 24 engaged with the base member 28.

Figure 6:
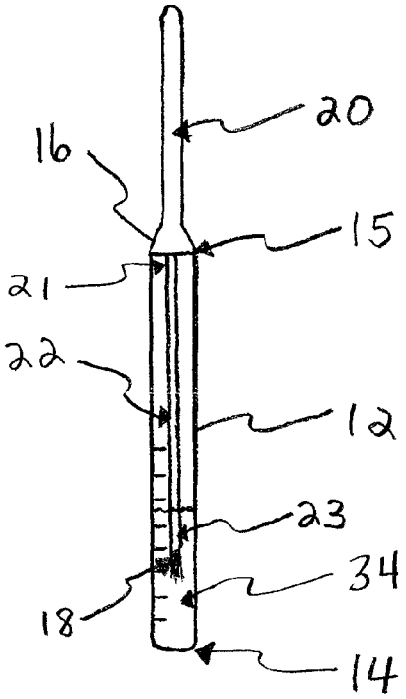
FIG. 6 is a perspective view of the applicator and applicator container.

FIG. 6 shows the applicator member 16 and applicator container 12. The applicator member 16 is attached to the applicator container 12. The applicator element 18 is submerged in a substance 34. Notches are shown on the side surface of the applicator container 12. In this embodiment, the applicator container 12 is clear to allow users to determine the remaining portion of substance 34. Alternatively, the applicator container 12 can be partially or completely opaque. A window in the applicator container 12 can be used to allow users to determine the level of the substance 34.

In one embodiment, the applicator assembly 10 comprises a base member 28, a cap member 24 removably associated with the base member 28, a container 12 for a substance to be applied, and an applicator member 16 removably associated with the container 12. An air-tight seal exists between the applicator member 16 and the applicator container 12. In one embodiment, the applicator assembly 10 is polymeric.

The container 12 and applicator member 16 are configured to be received within an interior space defined between the base member 28 and cap member 24. The base member 28 includes a recessed portion 30 and a mating portion 32. The cap member 24 includes a mating end 26 that corresponds to the mating portion 32 of the base member 28. In one embodiment, the cap member 24 is substantially cylindrical. The mating portion 32 of the base member 28 may be threaded. In another embodiment, the mating portion 32 of the base member 28 is a snap-fit.

The applicator container 12 includes a first end 14 shaped to be received by the recessed portion 30 of the base member 28. The applicator member 16 includes an elongated portion 22, a handle 20, located at a first end 21 of the elongated portion 22 and an applicator element 18 located at a second end 23 of the elongated portion 22. In one embodiment, the applicator element 18 of the applicator member 16 comprises a plurality of bristles forming a brush. In another embodiment, the applicator element 18 of the applicator member 16 is a thin solid element, for more precise application of the substance. In another embodiment, the applicator element 18 is a cotton ball.

The first end 14 of the applicator container 12 is a closed end. The second end 15 of the applicator container 12 is an open end. The first end 14 of the applicator container 12 is tapered. The applicator container 12 includes an indicator capable of conveying a level of remaining substance. For example, the indicator may consist of graded, visual notches on the side of the applicator container 12. The applicator container 12 includes a second end 15 that receives the applicator member 16. The handle 20 of the applicator member 16 is breakably attached to the second end 15 of the applicator container 12.

At least one of the base member 28, the container 12, the cap member 24, or the applicator member 16 includes a nail filing element. For example, the bottom surface of the base member 28 may include a nail filing element. In one embodiment, the base member 28 is substantially circular. In another embodiment, the base member 28 is substantially hexagonal.

During use of the applicator assembly 10, the user can manually crack or break the seal between the applicator container 12 and the applicator member 16. This allows the user to remove the applicator member 16 from the applicator container 12. The user is then free to insert the applicator member 16, with the applicator element 18 end first, into the applicator container 12 to apply a desired amount of substance to the applicator element 18. It may be desirable for the user to remove the applicator container 12 from the base member 28 to allow for easier application of the substance.

While various methods, configurations, and features of the present invention have been described above and shown in the drawings, one of ordinary skill in the art will appreciate from this disclosure that any combination of the above features can be used without departing from the scope of the present invention. It is also recognized by those skilled in the art that changes may be made to the above described methods and embodiments without departing from the broad inventive concept thereof.

What is claimed is:

1. A single use disposable applicator assembly comprising:

a base member including a mating portion and a recessed portion;

a cap member having a mating end that removably engages the mating portion of the base member;

a hollow applicator container for containing a substance in a volume suitable to be applied in a single use, the applicator container having an open end and a closed end distal to the open end, the closed end being shaped to be received by the recessed portion of the base member; and an applicator member removably associated with the applicator container, the applicator member suitable to access and contained within the substance contained in the applicator container via the open end, the applicator member including an applicator element and an applicator handle distal to the applicator element, the applicator element suitable for applying the accessed substance and the applicator handle suitable to control the applicator member during the single use, the applicator handle being removably attached to the open end of the applicator container to allow access to the substance, and the recessed portion of the base member mating with the closed end of the applicator container to support the applicator container, wherein the removably associated applicator member enables the applicator member to be removed from the applicator container for use and once removed the applicator member cannot be reattached to the applicator container to continue to contain the substance.

2. The applicator assembly of claim 1, wherein the cap member includes a mating end that corresponds to the mating portion of the base member.

3. The applicator assembly of claim 2, wherein the mating portion of the base member is threaded.

4. The applicator assembly of claim 2, wherein the mating portion of the base member is a snap-fit.

5. The applicator assembly of claim 1, wherein the closed end is shaped to be received by the recessed portion of the base member.

6. The applicator assembly of claim 5, wherein the closed end of the applicator container is tapered.

7. The applicator assembly of claim 5, wherein the open end receives the applicator member.

8. The applicator assembly of claim 1, wherein the applicator handle includes an elongated portion.

9. The applicator assembly of claim 8, wherein the handle is breakably attached to the open end of the applicator container.

10. The applicator assembly of claim 8, wherein the applicator element of the applicator member is bristles.

11. The applicator assembly of claim 8, wherein the applicator element of the applicator member is thin and solid.

12. The applicator assembly of claim 8, wherein the applicator element of the applicator member is a cotton ball.

13. The applicator assembly of claim 1, wherein the applicator container includes an indicator capable of conveying a level of remaining substance.

14. The applicator assembly of claim 1, wherein at least one of the base member, the container, the cap member, or the applicator member includes a nail filing element.

15. The applicator assembly of claim 1, wherein the bottom surface of the base member includes a nail filing element.

16. The applicator assembly of claim 1, wherein the cap member is substantially cylindrical.

17. The applicator assembly of claim 1, wherein an airtight seal exists between the applicator member and the applicator container.

18. The applicator assembly of claim 1, wherein every element is polymeric.

19. The applicator assembly of claim 1, wherein the base member is substantially circular.

20. The applicator assembly of claim 1, wherein the base member is substantially hexagonal.

* * * * *